United States Patent [19]

Flider

[11] 4,262,448

[45] Apr. 21, 1981

[54] SAFETY STORAGE CABINET

[75] Inventor: Frank S. Flider, Mattoon, Ill.

[73] Assignee: Justrite Manufacturing Company, Mattoon, Ill.

[21] Appl. No.: 50,465

[22] Filed: Jun. 20, 1979

[51] Int. Cl.[3] ..... E05C 7/05

[52] U.S. Cl. ..... 49/367; 49/7; 312/214; 312/324

[58] Field of Search ..... 312/138, 214, 236, 257 R, 312/263, 324; 49/1, 7, 379, 369

[56] References Cited

U.S. PATENT DOCUMENTS

| | | | |
|---|---|---|---|
| 3,023,068 | 2/1967 | Haag | 312/263 |
| 3,403,954 | 10/1968 | Williams | 49/7 |
| 4,146,994 | 4/1979 | Williams | 49/379 |

*Primary Examiner*—Casmir A. Nunberg

*Attorney, Agent, or Firm*—Alter and Weiss

[57] ABSTRACT

A safety cabinet for the storage of flammable or combustible materials has doors and a closure mechanism designed to automatically close and latch the doors in the event of fire. In one version, apparatus is provided to time the closing of the doors to insure a complete seal and lock. In a second version, apparatus is provided to seal the cabinet independently of the closing sequence of the doors.

11 Claims, 22 Drawing Figures

A
B
C

SAFETY STORAGE CABINET

The present invention relates generally to safety cabinets for flammable or explosive materials and, more particularly, to a safety cabinet having doors which automatically close and latch responsive to a detected rise in ambient temperature caused by fire.

The danger of fire in an industrial plant is greatly magnified by the storage within the plant of materials which may either catch fire or explode, thus intensifying and spreading the effects of the original fire. To eliminate this danger, it has often been necessary to store such flammable liquids outside the plant, or to keep such liquids locked up, preferably inside fire-proof cabinets, to insulate such materials from the direct effects of a fire.

Such procedures have numerous serious drawbacks. Perhaps the most serious is that the less convenient and more stringent the procedure to be followed for safety, the less likely it is that personnel working in the plant will observe the procedure. For example, if a container of flammable liquid must be stored in a locked cabinet which must be unlocked each time the material is to be used, employees will undoubtedly ignore the necessity for locking up such liquids in favor of the convenience and heightened productivity which result when the liquids are freely and readily available.

Another concern is that delicate or expensive material, free access to which is desirable, may be damaged or destroyed in a fire. To protect such material, again, an effective expedient would be the storage of such material in a fire-proof cabinet.

Typically, such fire-proof cabinets are of double-walled construction, with a minimum air space between the inner and outer walls, intended to act as an insulator and to limit thereby the temperature rise within the cabinets. As an example, such cabinets are constructed with a one and one-half inch air space between the inner and outer walls, with similar construction for the doors.

Automatic door closures are old and well-known in the art, but do not solve the problem of enabling a cabinet to remain open for access, yet to close the doors responsive to the presence of a fire. Prior automatic door closures which are actuated by a rise in ambient temperature are often difficult or unreliable in operation, excessively bulky, easily defeated, or difficult for one working nearby to see.

Accordingly, the present invention has the following objects:

to provide fire-proof cabinets having door closures which automatically close and latch said cabinets responsive to conditions of combustion;

to provide such devices with door closures which provide protective and simple closing mechanism;

to provide such door closures in forms which are simple and reliable in operation;

to provide such door closures in forms which are compact and integral with said cabinets;

to provide such door closures in forms which automatically latch the doors when they are closed;

to provide such devices in forms simple and economical to manufacture; and to provide such devices in forms which enable said cabinets to be conveniently used in the absence of fire.

These and further objects will become more apparent upon consideration of the accompanying drawings wherein.

Figures 1, 2, 3, 4, 5, 6:
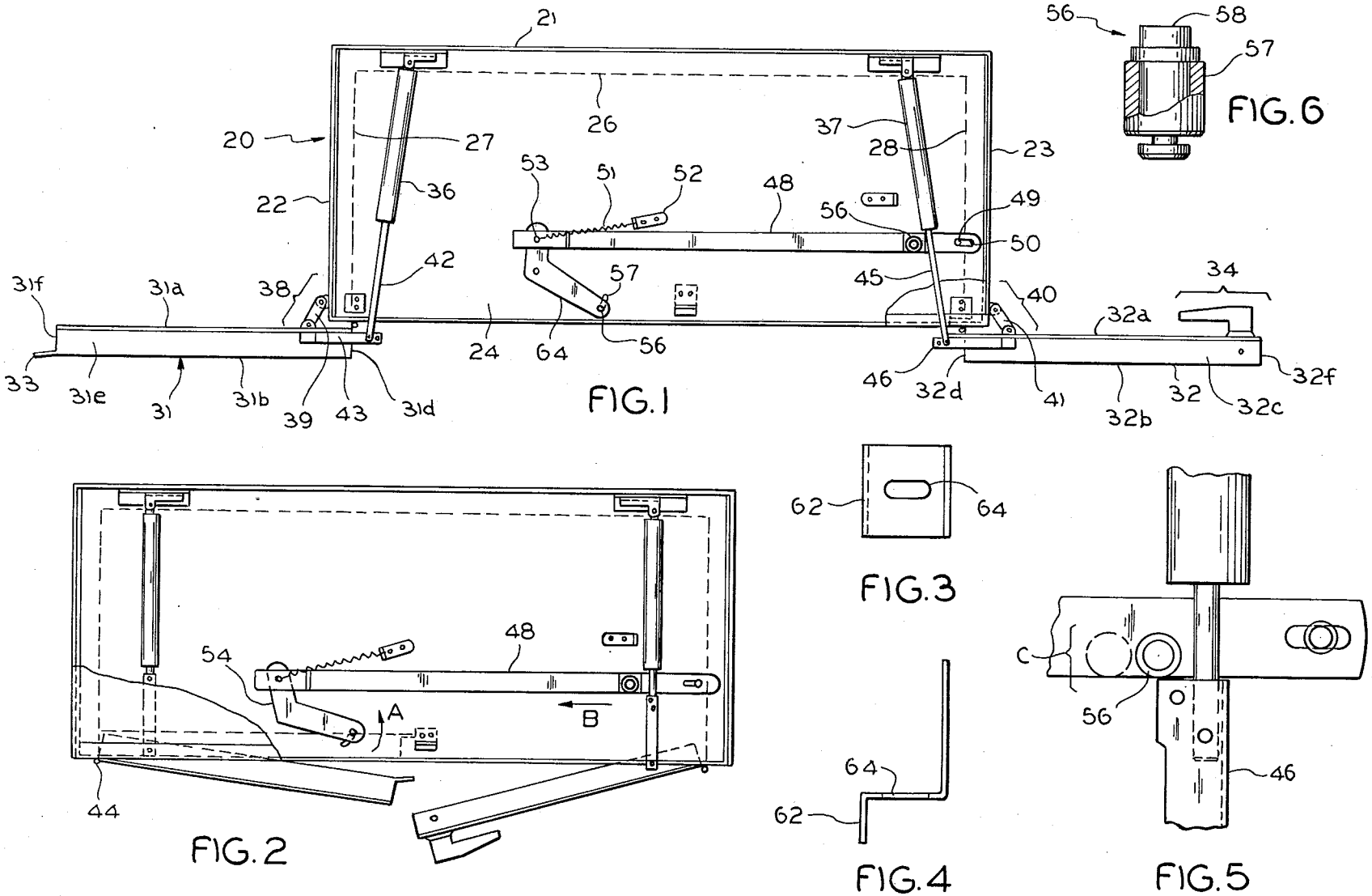
FIG. 1 is a top view of a fire-proof cabinet and automatic door closure.
FIG. 2 shows the device of FIG. 1 with the doors partially closed.
FIG. 3 is a top view of the door latch guide.
FIG. 4 is a side view of the door latch guide shown in FIG. 3.
FIG. 5 is a detail drawing illustrating the mechanism holding one door of said cabinet in a partially open position.
FIG. 6 is a partial sectional view of the stop roller and stud assembly of FIG. 1.
Figure 7:
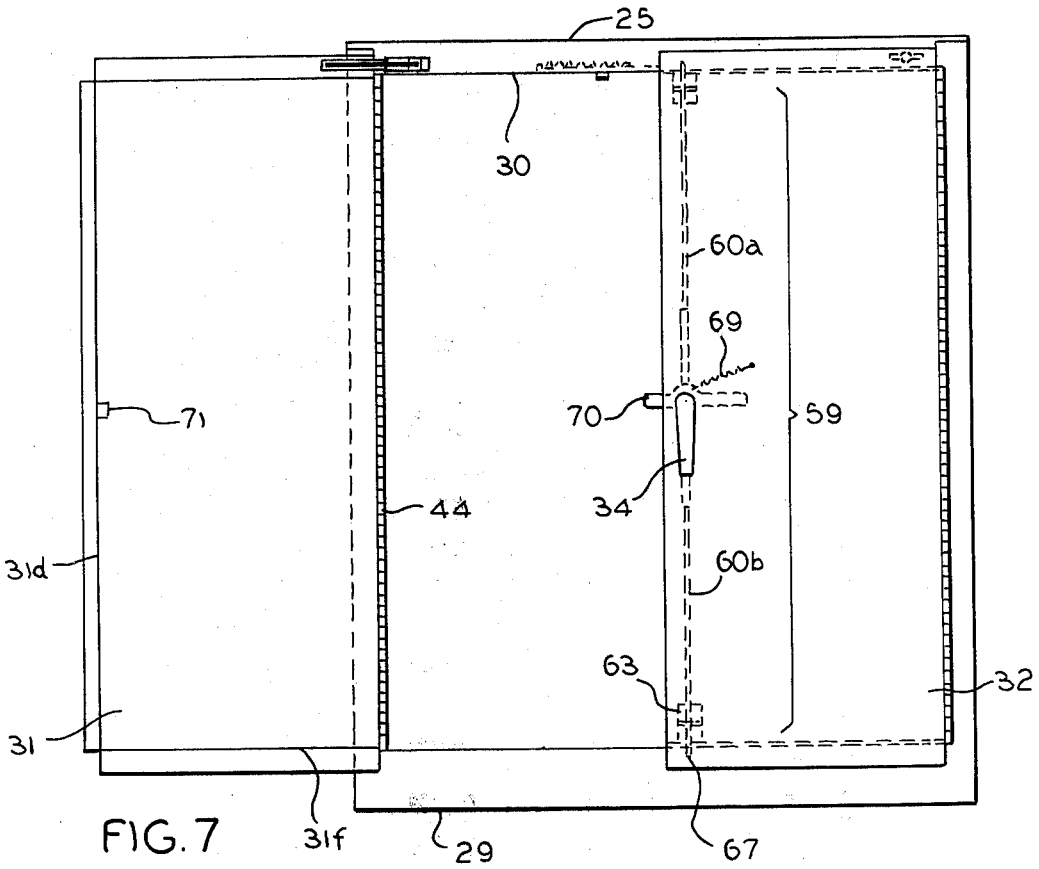
FIG. 7 is a front elevation of a cabinet incorporating a first embodiment of the present invention.

Referring now to FIG. 1, the numeral 20 indicates generally a fire-proof cabinet assembly having an outer rear wall 21, an outer left side wall 22, an outer right side wall 23, and an inner floor 24. As best seen in FIG. 7, cabinet 20 also has a top having an outer top wall 25.

In keeping with one preferred construction of fire-proof cabinets, cabinet 20 is a double-walled construction, wherein each said wall has a corresponding inner wall, with said inner and outer walls separated by a dead air space. Thus, in FIG. 1, outer rear wall 21 has a corresponding inner rear wall 26, outer left side wall 22 and outer right side wall 23 have corresponding inner walls 27 and 28, respectively, while as best seen in FIG. 7, inner floor 24 has corresponding outer wall 29, and outer top 25 has a corresponding inner top wall 30.

As best seen in FIGS. 1 and 2, the front of cabinet 20 is selectively closed off by a pair of doors, with left hand door 31 having a similar double wall construction, with outer door front 31*a* spaced apart from inner door front 31*b*, by side walls 31*c*, 31*d*, 31*e* and 31*f* defining an enclosed dead air space. Right hand door 32 is of similar construction, with side walls 32*c*, 32*d*, 32*e* and 32*f* joining outer door front 32*a* and inner door front 32*b*.

Figure 8:
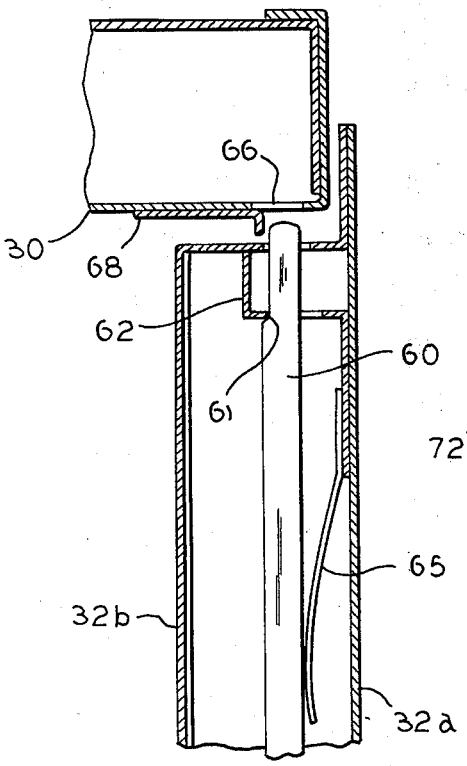
FIG. 8 is a partial sectional view illustrating the automatic latching mechanism prior to latching.
Figure 9:
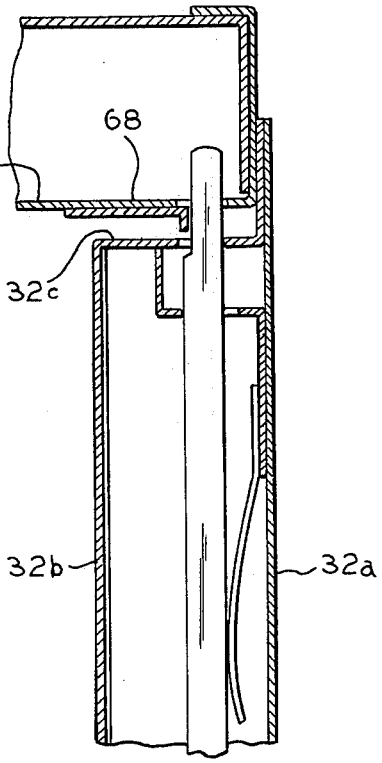
FIG. 9 is a view of the assembly in FIG. 8 showing the door in a latched position.

In the embodiment illustrated in FIGS. 1 and 2, left hand door 31 has extended sealing lip 33 protruding along side wall 31*f*. Right hand door 32 has a latching mechanism generally indicated at 34 with which said cabinet may be selectively latched in a manner to be described more fully hereinbelow. As best seen in FIGS. 7, 8 and 9, outer door wall 32*a* overlaps the opening of cabinet 10 along the top and bottom, as does outer door wall 31*a*.

Thus, when doors 31 and 32 are closed, cabinet 20 defines an inner protected air space 35 surrounded top, bottom, sides, back and front by double-walled elements having insulating air spaces created therebetween. It is contemplated that articles placed within said cabinet 20 will be protected from the effects of fire when said doors 31 and 32 are closed and latched.

In a preferred embodiment of the present invention, doors 31 and 32 remain normally in an open position, with means provided to automatically close and latch said doors in the event of fire. In the preferred embodiment illustrated in FIGS. 1 and 2, left door 31 is urged to a closed position by, for example, air cylinder 36, while right door 32 is similarly urged to a closed position by air cylinder 37.

Means are provided to retain left door 31 in an open position, such as illustrated at 38. In a preferred embodiment, said retaining means 38 includes a fusible link 39 which, at a preselected ambient temperature, fuses or melts, thus releasing left door 31 and enabling cylinder 36 to pull said door into a closed position.

A similar retaining element 40 is used to hold right door 32 in an open position, and fusible link 41 similarly provides means to release right door 32 in the event of a rise in ambient temperature.

As best seen in FIG. 1, shaft 42 of air cylinder 36 is attached to left door link 43, which, in turn, is attached to outer door wall 31*a* of left door 31. As best seen in FIG. 7, left door 31 is preferably hinged to cabinet 20 by hinge 44 which extends substantially the full height of left door 31. A similar arrangement is contemplated for right door 32, whereby shaft 45 of air cylinder 37 is pivotally attached to right door link 46, right door 32, in turn, is hinged upon hinge 47 which, again, extends substantially the full height of right door 32.

As best seen in FIG. 2, when left door 31 is closed, right door 32 may then be closed to engage sealing lip 33. Thus, during any automatic closing of doors 31 and 32, it is necessary that said doors close in sequence wherein left door 31 reaches a closed position prior to right door 32. This sequence must be maintained regardless of the sequence in which fusible links 39 and 41 melt.

A preferred embodiment to time the closing of doors 31 and 32 includes a timing slide bracket 48 which is positioned between top wall 30 and outer top wall 25 of cabinet 20. Timing slide bracket 48 is slidably mounted upon slide pivot stud 49, and may be moved left or right, limited by the dimensions of slot 50, formed in timing slide bracket 48 through which slide pivot stud 49 protrudes. Slide bracket spring 51 is attached to spring anchor 52, and at its other end, to timing slide bracket 48 at 53. Thus, timing slide bracket 48 is normally urged to a full righthand position, with slide pivot stud 49 positioned at the leftmost extreme of slot 50.

Actuating lever arm 54 is pivotally mounted to inner top wall 30 by actuating stud 55, and is pivotally attached to timing slide bracket 48 at 53. As seen in FIG. 1, actuating arm 54 has guide stud 56 positioned in arcuate slot 57 formed in wall 30. Thus, rotation of actuation arm 54 about pivot stud 55 is limited and guided by slot 57.

As best seen in FIG. 2, when actuating arm 54 is moved in the direction indicated by A, timing slide bracket 48 is pulled in a leftward direction B.

As best seen in FIG. 5, timing slide bracket 48 has stop roller stud 56 mounted thereon. A partial elevation and side sectional view of stop roller stud 56, as seen in FIG. 6, illustrates that, in this preferred embodiment, stop roller stud 56 includes an outer rotatable collar 57 and a central stud shaft 58 upon which collar 57 is journalled.

When doors 31 and 32 to cabinet 20 are held open, and timing slide bracket 48 is positioned in its rightwardmost attitude, stop roller stud 56 is positioned as shown in FIG. 1. As best seen in FIG. 5, stop roller stud 56 will contact right door link 46 as right door 32 closes responsive to the release of door 32 by the fusing of fusible link 41 in retaining assembly 40. In this manner, the closing of door 32 will be arrested by stop roller stud 56.

As best illustrated in FIGS. 2 and 5, door 32 will remain partially open until timing slide bracket 48 moves leftward a sufficient distance to position stop roller stud 56 out of the path of door bracket 46. Such a position is illustrated in phantom at C of FIG. 5.

Movement of timing slide bracket 48 is accomplished as follows. When fusible link 39 has released door 31, said door 31 is drawn closed by gas cylinder closure 36 about hinge 44 until inner door wall 31*b* contacts actuating arm 54. Sufficient force is thus exerted on actuating arm 54 to pivot said arm about pivot stud 55 thereby drawing timing slide bracket 48 leftward, in direction B, moving stop roller stud 56 to position C and allowing door 32 to complete its closing movement. In this manner, it is assured that door 31, with sealing lip 33, will close fully before door 32, thus providing a protective seal.

Once closed, doors 31 and 32 must remain closed for maximum safety. To provide automatic latching capability, a latch rod assembly 59 is provided as seen in FIG. 7.

Said latch rod assembly 59 includes latch rod 60 having shoulder 61 formed thereon, and upper latch bracket 62 and lower latch bracket 63 as seen in FIGS. 3, 4 and 7, respectively, within which latch rod 60 is maintained. As best seen in FIGS. 3 and 4, each such latch bracket 62 and 63 has an oval slot 64 formed therein, enabling latch rod 60 to be moved slightly in a horizontal direction.

As best seen in FIG. 8, upper latch bracket 62 is attached to the inner side of outer door wall 32*a*. Also attached to outer door wall 32*a* is spring 65, interposed between wall 32*a* and latch rod 60 to hold latch rod 60 in its rearmost position.

In a preferred embodiment, latch rod 60 includes an upper latch rod segment 60*a* and a lower latch rod segment 60*b*, as best seen in FIG. 7. When latch assembly 34 is in an unlatched position, handle 59 is held horizontally, as seen in phantom in FIG. 7. Upper and lower latch rod segments 60*a* and 60*b* are pivotally attached to latch assembly 34 in any conventionally known manner such that in an unlatched position, upper latch rod segment 60*a* is drawn downward and lower latch rod segment 60*b* is drawn upward.

As best seen in FIGS. 8 and 9, inner top wall 30 has upper latch aperture 66 formed therethrough to register with latch rod 60 when door 32 is closed. A similar aperture is formed through inner floor 24, as indicated in FIG. 7. Thus, in its unlatched position, upper latch rod 60*a* is withdrawn from upper latch aperture 66, and lower latch rod segment 60*b* is withdrawn from lower latch aperture 67.

In a preferred embodiment, latch rod segments 60*a* and 60*b* are held in an unlatched position by the urging of spring 65 holding shoulder 61 of latch rod segment 60*a* in contact with bracket 62.

To effect automatic latching of door 32, latch stop 68 is provided, as seen in FIGS. 8 and 9. Latch stop 68 is positioned to contact upper latch rod 60*a* when door 32 has completely closed, pushing latch rod 60*a* outward and releasing shoulder 61 from bracket 62. To effect the automatic upward movement of latch rod segment 60*a* and the corresponding lower movement of latch rod 60*b*, latch handle spring 69 is provided such that rotation of latch handle 59 to an unlatched position stresses spring 69. When latch rod segment 60*a* is released, the force of spring 69 causes latch handle 59 to rotate to a closed position, thus moving upper latch rod segment 60*a* upward through aperture 66, and lower latch rod segment 60*b* downward through aperture 67. To provide further latching security, tongue 70 is formed to protrude leftward, as shown in FIG. 7, when handle 59 is moved to a latched position, and a corresponding slot 71 is formed in wall 31*f* of door 31 to accommodate said tongue.

Figure 10:
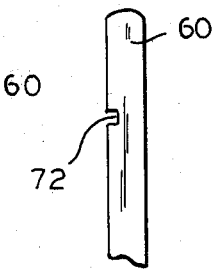
FIG. 10 is a partial elevation of one embodiment of a latch rod.

As shown in FIG. 10, an alternate construction of latch rod 60 may include milled groove 72 in lieu of shoulder 61. It is to be understood, however, that said groove 72 retains latch rod 60 in much the same manner as shoulder 61.

Figure 11:
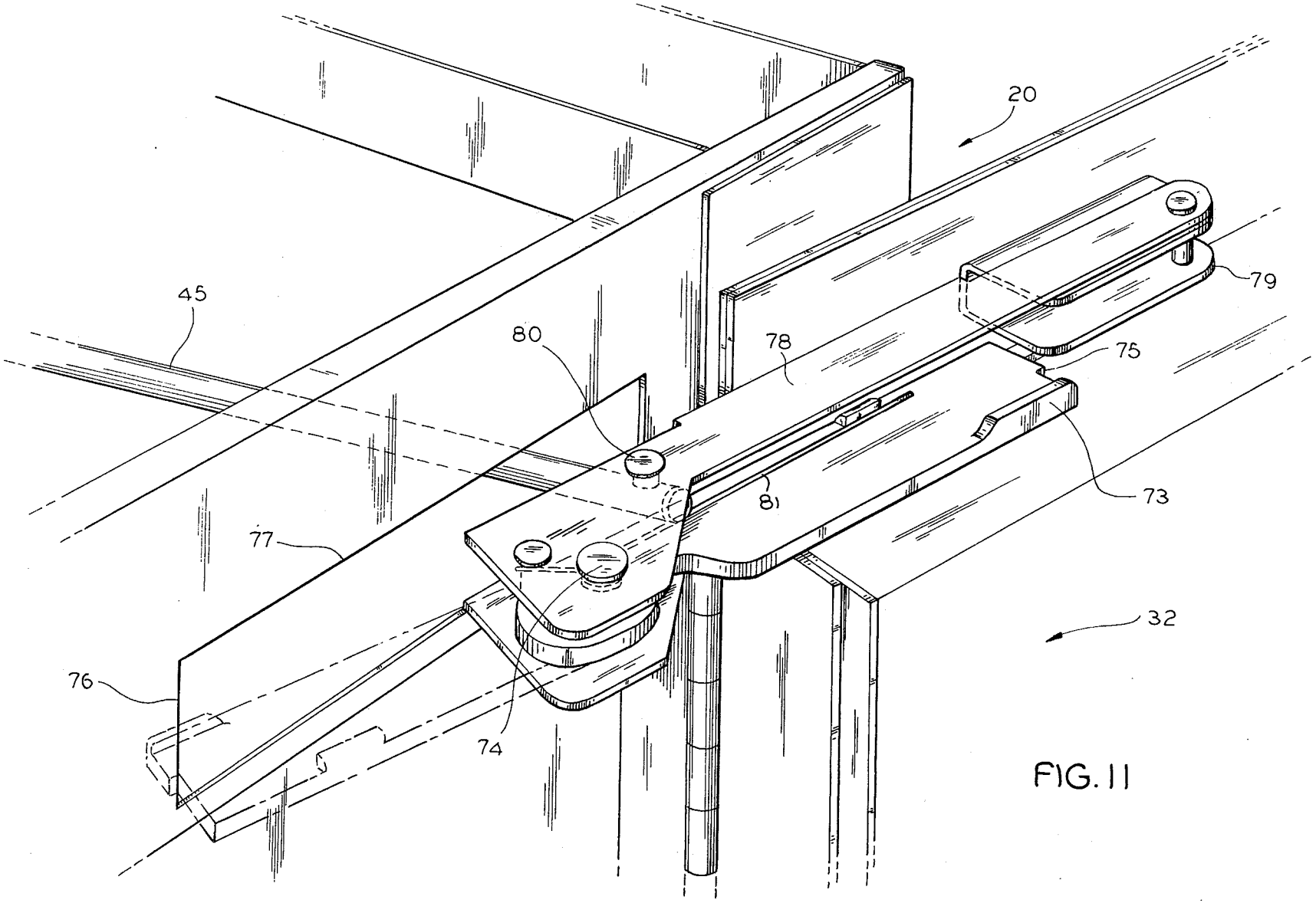
FIG. 11 is a perspective view of a variation of the fusible link assembly of FIG. 1.

As seen in FIG. 11, another embodiment of the present invention utilizes fusible link lever 73 to hold right door 32 in an open position. As illustrated in phantom, link lever 73 is rotated about lever pivot 74 to engage tab 75 with edge 76 of rectangular cutout 77 formed through the face of cabinet 20. In this manner, link lever 73 will hold right door 32 in an open position, opposing the force exerted on door link 78 by gas cylinder shaft 45 to draw door 32 to a closed position. As herein illustrated, door link 78 is pivotally attached to door yoke 79 at one end, and is pivotally attached to cylinder shaft 45 at 80 proximate the remaining end.

To insure more positive operation of the automatic closing feature, link lever 73 may be spring biased to urge it, normally, into the "rest" position illustrated in solid at FIG. 11. Thus, upon a rise in ambient temperature sufficient to melt portion of link lever 73, lever spring 81 will urge link lever 73 to its rest position, thereby enabling right door 32 to close completely. It is to be understood that the construction hereinabove discussed may also be utilized on left door 31.

Figure 12:
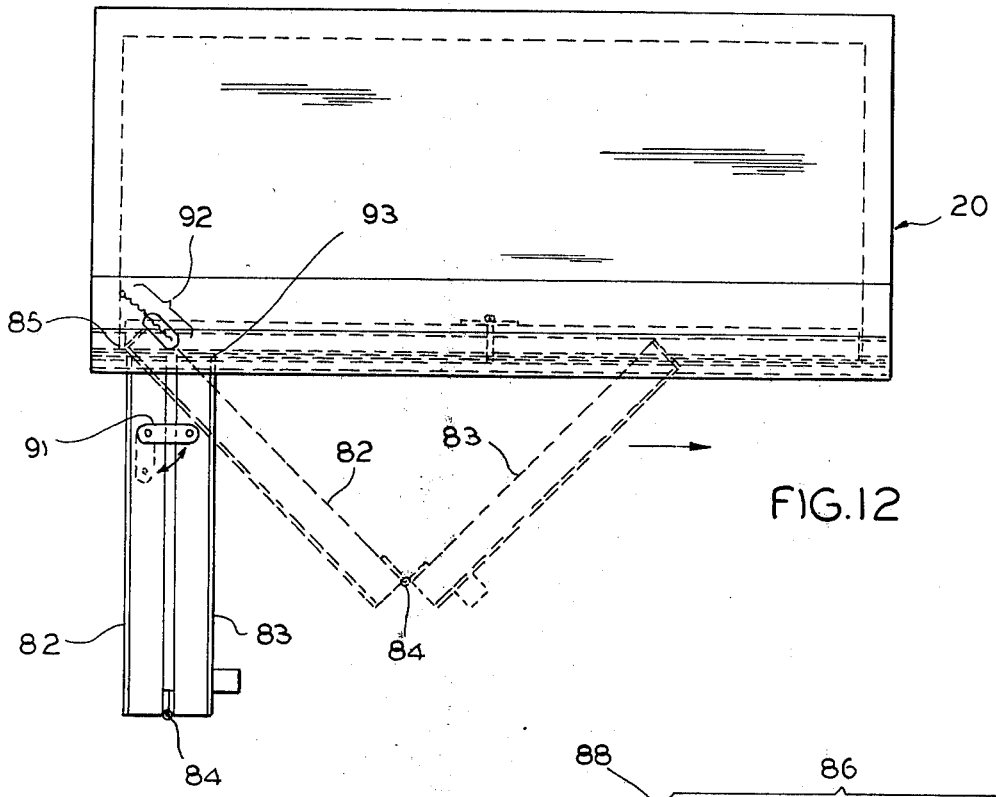
FIG. 12 is a top plan view of a variation of door construction.

As best seen in FIG. 12, another embodiment of the present invention includes a pair of doors 82 and 83 hinged together at 84 in a "fan-fold" configuration. Door 82 is hinged to cabinet 10 at 85 and, as seen in phantom in FIG. 12, said doors 82 and 83 may be moved horizontally to close cabinet 20.

To accomplish such movement, hinge 84 is constructed as a spring loaded hinge to urge doors 82 and 83 to close in the direction illustrated in FIG. 12.

Figure 13:
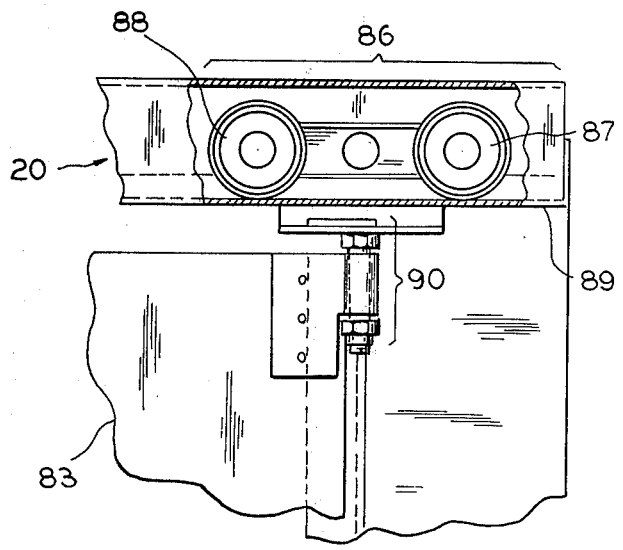
FIG. 13 is a partial detail of the door guide assembly of FIG. 12.
Figure 14:
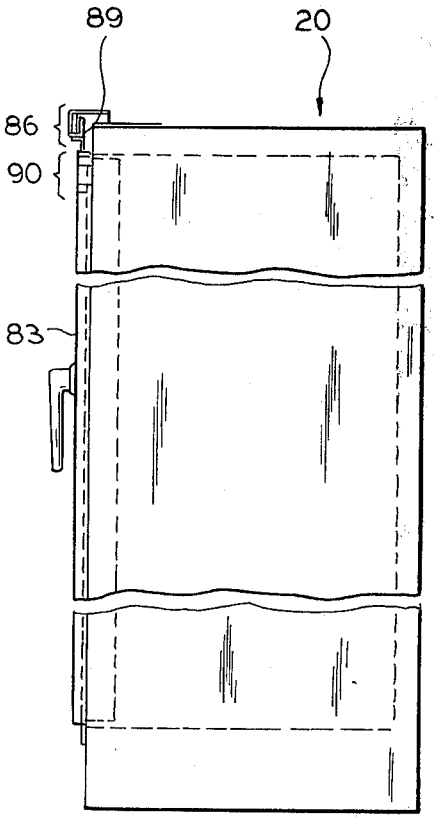
FIG. 14 is a partial side elevation of the cabinet shown in FIG. 12.
Figure 15:
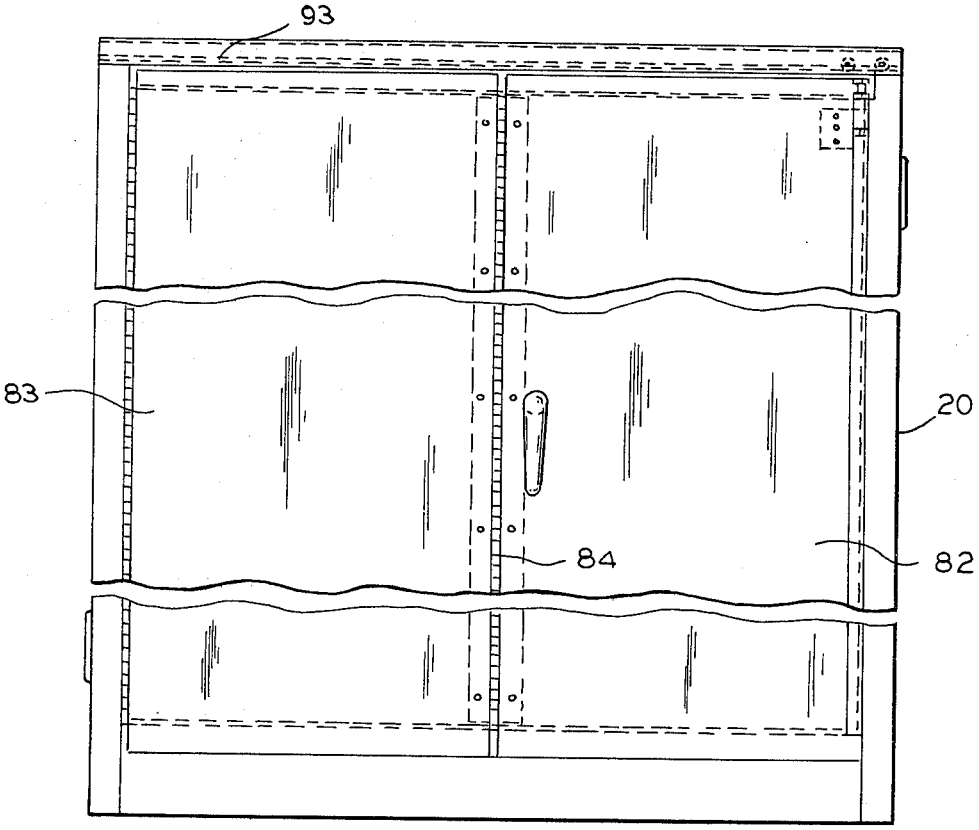
FIG. 15 is a front elevation of the cabinet of FIG. 12.

FIG. 13 and FIG. 14 illustrate door guide assembly which includes a carriage 86 having rollers 87 and 88 moving along overhead track guide assembly 89 formed on cabinet 20. Said guide assembly 89 is pivotally attached to door 83 by pivot assembly 90. In this manner, movement of doors 82 and 83, from a full open to a full closed position, is facilitated. FIG. 14 illustrates a side view of said track guide assembly 89 and roller assembly 86 when doors 82 and 83 are in a full closed position, while FIG. 15 illustrates cabinet 20 with doors 82 and 83 in a fully closed position.

As best seen in FIG. 12, a fusible link to hold doors 82 and 83 in an open position may be positioned either across the top of said doors, as at 91, or as part of a chain and link configuration as seen at 92.

As an alternative, said fusible link may take the form of a pin, 93, as seen in FIG. 12, which extends downward into track guide assembly 89 a sufficient distance to contact and intercept door 83 when doors 82 and 83 are in a fully opened position. Said pin 93 may be spring loaded and may be moved upward against the force of said spring to allow doors 82 and 83 to be selectively closed. Upon a rise in ambient temperature, pin 93 would melt, thereby freeing doors 82 and 83 to close cabinet 20.

Figure 16:
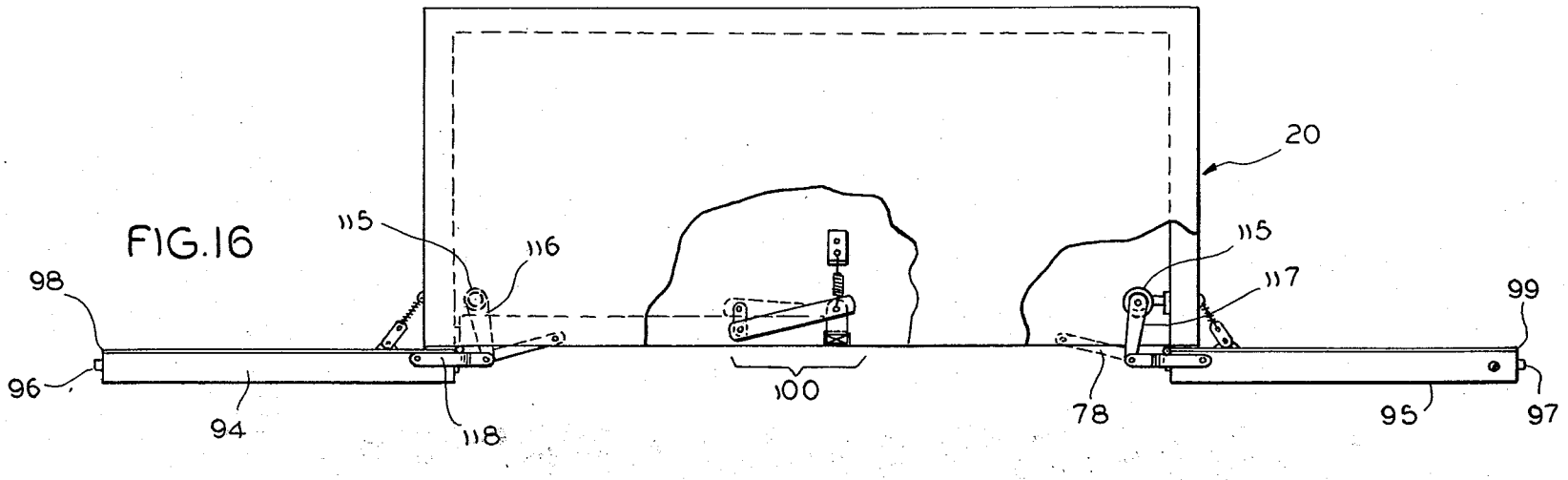
FIG. 16 is a top plan view of an additional embodiment of the present invention.
Figure 22:
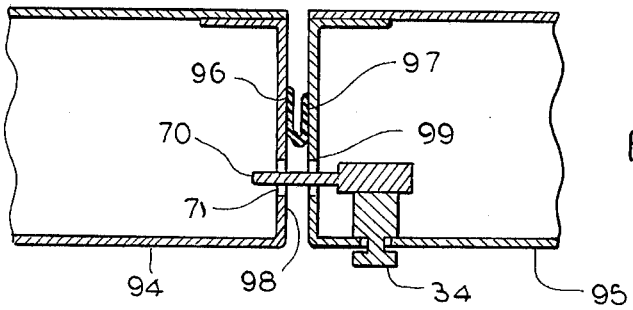
FIG. 22 is a partial detail of sealing gasket and handle assembly of FIG. 16.

Another embodiment of the present invention eliminates the need for timing the closing of one cabinet door to enable the other cabinet door to close first. As best seen in FIG. 16 and FIG. 22, left door 94 and right door 95, respectively, have extruded gasket strips 96 and 97 attached along door edges 98 and 99. Gaskets 96 and 97 are sized, shaped and positioned to interlock when doors 94 and 95 are closed, thus sealing cabinet 20, no matter which door closes first.

Figure 20:
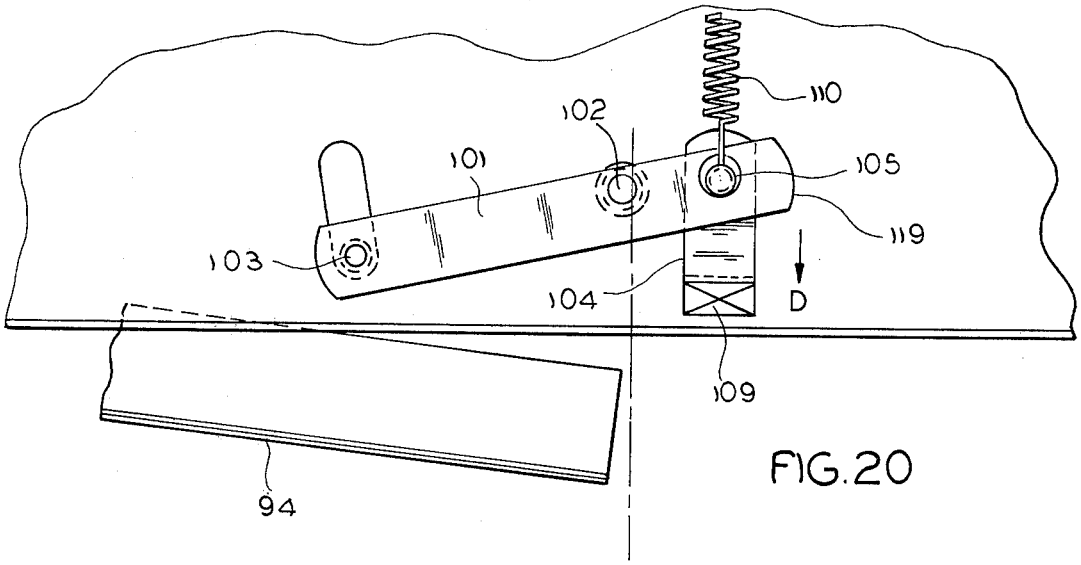
FIG. 20 is a partial detail of the latch actuating mechanism of FIG. 16 with one door partially closed.
Figure 21:
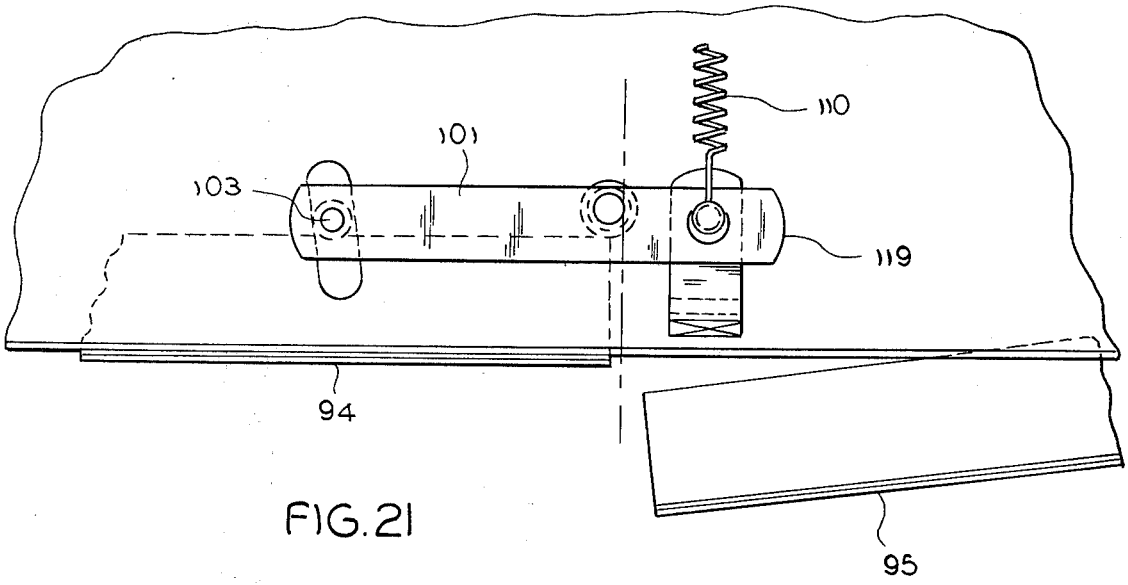
FIG. 21 is a partial detail of the view in FIG. 20, showing one door closed and another partially closed.

In order to provide means to automatically latch cabinet 20, latch control 100 is provided, as best seen in FIGS. 20 and 21. Latch control 100 includes actuating lever 101 pivotally supported by stud 102. Actuating stud 103, positioned at one end of actuating lever 101 extends downward to a point wherein left door 94 will contact actuating stud 103 when said door is closing, thereby pivoting actuating lever 101 on pivot stud 102, moving end 102 of actuating lever 101 in direction D, as illustrated in FIG. 20.

Figure 18:
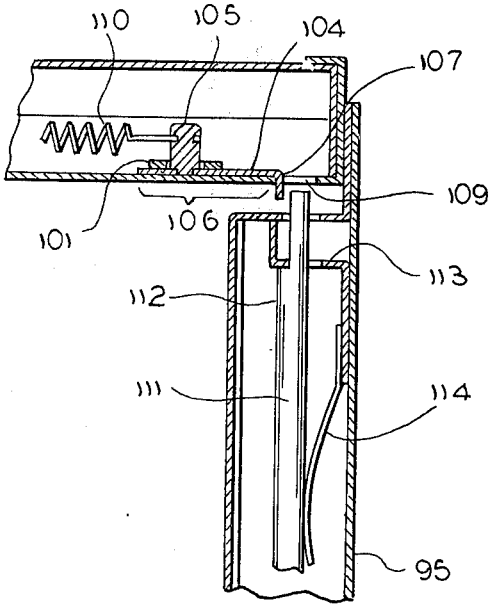
FIG. 18 is a partial sectional view of the latch mechanism of FIG. 16 prior to latching.
Figure 19:
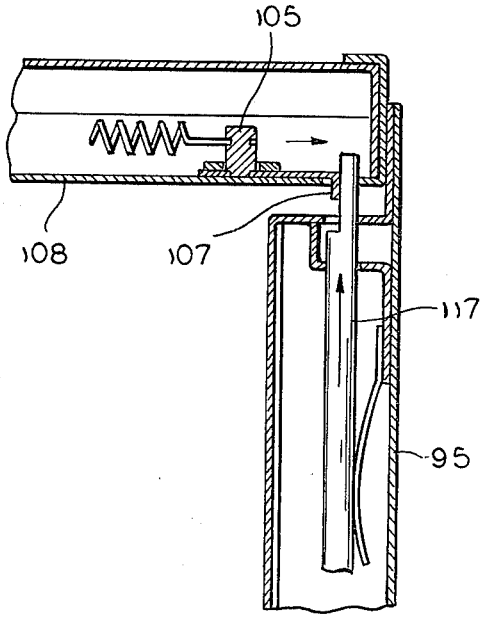
FIG. 19 is a partial sectional view of the mechanism of FIG. 18 after latching.

As best seen in FIGS. 18, 19 and 20, latch trip bracket 104 is pivotally attached to actuating lever 101 by spring stud 105. Latch trip bracket 104 has a horizontally extending segment 106 and a depending segment 107, and inner top wall 108 has slot 109 formed therethrough, through which depending segment 107 extends downwardly into the interior of cabinet 20. Latch bracket spring 110 is secured at one end to the top cabinet 20 and at its other end to spring stud 105. In its rest or unstressed position, latch spring 110 draws latch trip bracket 104 to its rearmost point of travel within slot 109.

As seen in FIG. 21, when left door 94 is fully closed, end 119 of actuating lever 101 is moved forward, thereby moving latch trip bracket 104 in a forward direction within slot 109. When left door 94 is reopened, the force exerted by latch spring 110 draws latch trip bracket 104 back to its rearmost position in slot 109.

As best seen in FIGS. 18 and 19, door 95 has latch rod 111 mounted therein in much the same fashion as hereinabove described in FIGS. 8, 9 and 10. Latch rod 111 has shoulder 112 formed thereon, and door latch guide 113 is shaped and sized to engage said shoulder in order to hold latch rod 111 in the off position as shown in FIG. 18. Latch rod spring 114 provides a lateral force to hold latch rod 111 in said off position.

Latch rod 111 has a lower counterpart corresponding to 60*b* of FIG. 7, and is attached to an assembly corresponding to handle and cam assembly 34. In the manner hereinabove described, said cam assembly 34 is spring biased to move to a locked position when latch rod 111 is released. Again, in similar fashion, a tongue corresponding to tongue 70 moves to engage a slot corresponding to slot 71, thereby securely latching and locking cabinet 20.

Release of latch rod 111 is accomplished in the following manner. As left door 94 closes and engages actuating lever 101, latch trip bracket 104 is moved forward in slot 109 as seen in FIG. 19. When depending segment 107 of latch trip bracket 104 contacts latch rod 111, said shoulder 112 is disengaged from bracket 113, and latch rod 111 is moved upward by the force of spring 69 which, simultaneously, pivots handle assembly 34 to engage slot 71 with tongue 70.

Should left door 94 close before right door 95, latch trip bracket 104 will be in position to engage latch rod 111, thereby latching said cabinet 10. Should right door 95 close before left door 94, said latch rod would not release until left door 94 closes and engages actuating lever 101 to move latch trip bracket 104 in a forward direction.

Figure 17:
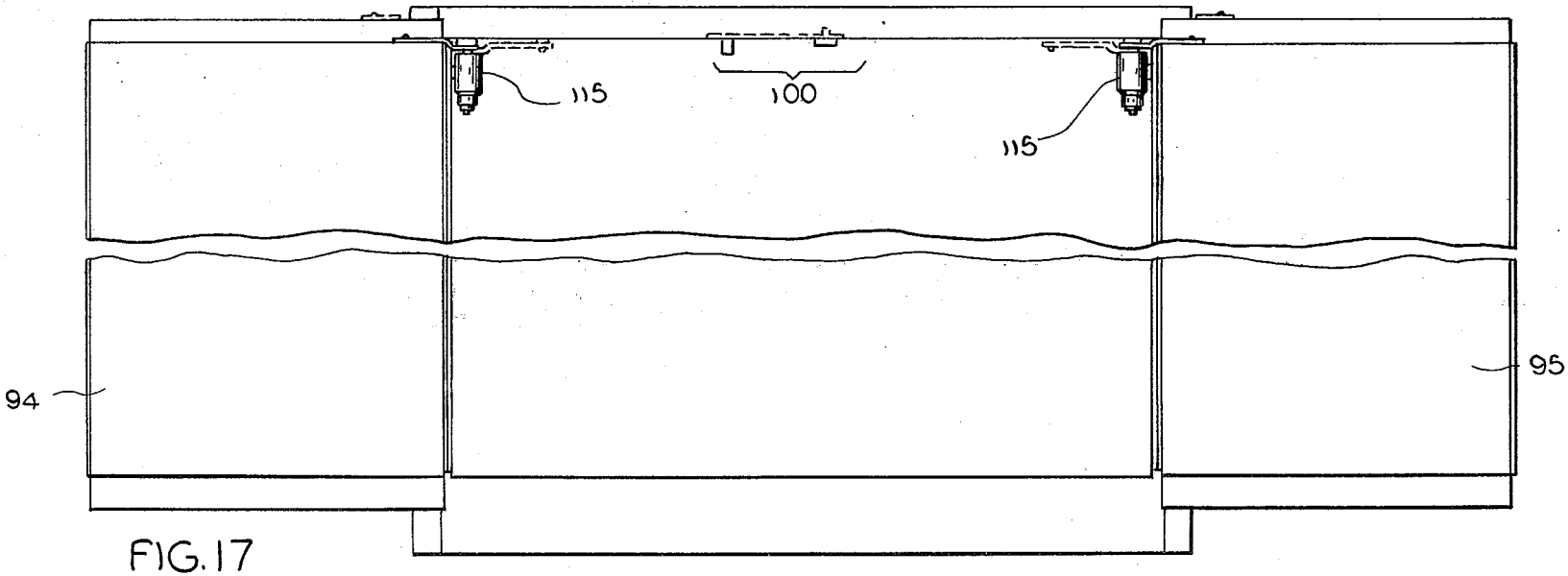
FIG. 17 is a partial front elevation of the embodiment in FIG. 16.

As best seen in FIG. 17, another acceptable means for biasing doors 31 and 32 to move towards a closed position may also be accomplished by use of miniature door checks, such as those illustrated at 115. As best seen in FIG. 16, each said door check has a pivoting arm 116 and 117, respectively, pivotally attached to door link 78 and 118. Said door checks have the advantage of occupying very little space within cabinet 20 and are easy to install and maintain.

Although not specifically illustrated herein, it is to be understood that other door configurations may be utilized as dictated by such considerations as the size of the cabinet 20. By way of example, a plurality of doors may be arranged in fan-fold fashion to close off a large cabinet opening. Alternatively, a small opening may be closed off by a single door.

While the foregoing has presented specific embodiments of the invention herein, it is to be understood that these embodiments are presented by way of example only. It is expected that others, skilled in the art, will perceive variations which, while differing from the foregoing, do not depart from the spirit and scope of the invention as herein described and claimed.

I claim:

1. A door closure mechanism for a cabinet, said cabinet of the type having a top, a bottom, sides, a back, and a front, said closure mechanism adapted to close off said cabinet front, said closure mechanism comprising:

a first door hinged to said cabinet front proximate one said side;

a second door hinged to said cabinet front proximate the remaining of said sides;

closing means to urge said first and second doors to a closed position;

means mounted to the interior of said cabinet to time the closing of said doors, said timing means including an actuating bracket pivotally attached interiorly to said cabinet top;

a slide bar pivotally attached to said actuating bracket, said slide bar being held by a spring in a first position, said slide bar moveable to a second position when said actuating bracket is pivoted;

means on at least said first door to extend toward said slide bar as said door is closing;

means on said slide bar to engage said extension means to hold said first door in a partially open position, said engaging means being defeated when said second door closes to contact said actuating bracket;

means to latch said doors in a closed position responsive to the closing of said doors; and means to prop said doors in an open position, said prop means including link means pivotally mounted to each said door, said link means having a first unextended position and a second extended position, said link means being spring biased to remain normally in said first position, and means to engage said link to said cabinet when said link is in said second position, said link being fashioned from heat-fusible material whereby a selected rise in ambient temperature will fuse said link thereby releasing one said door from its open position and enabling said door to close.

2. The apparatus as recited in claim 1 wherein said extension means comprises a bracket attached to said door proximate said hinge, said closing means pivotally associated with said bracket;

said link means pivotally associated with said bracket.

3. The apparatus as recited in claim 1 wherein each said link engagement means includes a slot formed in the front of said cabinet, said slot being covered when each said door is in said closed position.

4. The apparatus as recited in claim 3 wherein said exterior engaging means includes a roller mounted upon said slide bar.

5. The apparatus as recited in claim 4 wherein said roller contacts said door bracket as said door bracket moves into said cabinet when said slide bar is in said first position, said roller disengaging said bracket when said slide bar is moved to said second position.

6. The apparatus as recited in claim 1 wherein said top is of double-wall construction, formed from upper and lower top members defining an air space therebetween, said timing means being disposed within said space.

7. A door closure mechanism for a cabinet, said cabinet of the type having a top, a bottom, a back, sides, and a front, said closure mechanism sealing off said front when closed, said closure mechanism comprising:

a first door hinged to said cabinet front proximate one said side;

a second door hinged to said cabinet front proximate said remaining side;

closing means to urge said first and second doors to a closed position;

means to latch said doors to said cabinet responsive to the closing of said doors;

means mounted to the interior of said cabinet to time the latching of said doors, said latch timing means including a slot formed in said cabinet, an actuating bracket extending through said slot and moveable within said slot in a front to rear direction, said actuating bracket being spring-biased to remain normally at the rear of said slot;

means to move said actuating bracket forward in said slot responsive to the closing of one said door, said actuating bracket thereby contacting and releasing said latching means carried within said remaining door;

means to prop said doors in an open position, said prop means including link means pivotally mounted to each said door, said link means having a first unextended position and a second extended position, said link means being spring-biased to remain normally in said first position, and means to engage said link to said cabinet when said link is in said second position, said link being fashioned from heat-fusible material whereby a selected rise in ambient temperature will fuse said link thereby releasing said door from its open position and enabling said door to close.

8. The apparatus as recited in claim 7 wherein each said link engagement means includes a slot formed in the front of said cabinet, said slot being covered when each said door is in said closed position.

9. The apparatus as recited in claim 7 wherein each said door has a sealing gasket positioned along the door side opposite said hinge, said sealing elements engaging when said doors are closed to seal off said cabinet.

10. The apparatus as recited in claim 7 wherein said top is of double-wall construction, formed from upper and lower top members defining an air space therebetween, said latch timing means being disposed within said air space, said slot being formed in said lower top member.

11. A door closure mechanism for a cabinet, said cabinet of the type having a top, a bottom, a back, sides, and a front, said closure mechanism sealing off said front when closed, said closure mechanism comprising:

a first door hinged to said cabinet front proximate one said side;

a second door hinged to said first door in fan-fold configuration;

closing means to urge said first and second doors to a closed position;

means to latch said doors to said cabinet responsive to the closing of said doors;

means mounted to the interior of said cabinet to actuate said latch means;

means to guide said doors to said closed position, said guide means including a trolley attached to said second door, said guide means further including a track attached to the interior of said cabinet proximate to the top of said front; and means to retain said doors in an open position, said retaining means including a stop member extending into said track to engage said trolley, said stop member being spring biased to remain normally in an extended position, said stop member being fashioned from heat-fusible material wherein a selected rise in ambient temperature will fuse said stop member and cause said doors to move to said closed position .

* * * * *